US005634372A

United States Patent [19]

Tangen

[11] Patent Number: 5,634,372

[45] Date of Patent: Jun. 3, 1997

[54] LIQUID FUEL FRICTION APPLYING ENGINE STARTER

[76] Inventor: Clifford Tangen, Box 253, Wembley, Alberta, Canada, T0H 3S0

[21] Appl. No.: 450,798

[22] Filed: May 25, 1995

[30] Foreign Application Priority Data

Jun. 9, 1994 [CA] Canada ..... 2125538

[51] Int. Cl.[6] ..... F02N 7/10

[52] U.S. Cl. ..... 74/6; 180/221; 30/390

[58] Field of Search ..... 74/6, 138, 139; 180/205, 221; 30/388, 389, 390; 123/179.19, 179.22

[56] References Cited

U.S. PATENT DOCUMENTS

| | | | |
|---|---|---|---|
| 2,522,503 | 9/1950 | Dodwell | 74/6 |
| 3,735,489 | 5/1973 | Zatorsky, Jr. | 30/390 |
| 4,200,164 | 4/1980 | Pearne | 180/221 |
| 4,406,342 | 9/1983 | Lacroix | 180/221 |
| 4,531,482 | 7/1985 | Scheckel | 74/6 |
| 4,603,754 | 8/1986 | Matsutoh et al. | 180/221 |

OTHER PUBLICATIONS

Pages from Catalogue of Arrow Speciality Co., Tulsa, Oklahoma, with respect to Starting Crank, Arrow Portable Engine Starter and Ring Gear Starter published at least as early as Apr. 11, 1994.

*Primary Examiner*—Charles A. Marmor
*Assistant Examiner*—David M. Fenstermacher
*Attorney, Agent, or Firm*—Anthony R. Lambert

[57] ABSTRACT

A friction applying engine starter which includes a chassis having a first end, a second end, a top edge and a bottom edge. A gasoline fuelled two cycle engine mounted on the chassis. The engine has an output shaft. A fuel tank is mounted on the chassis and is coupled with the engine to supply fuel. A friction roller is rotatably mounted at a first end of the chassis. A gear assembly is provided including a plurality of gears that are rotatably mounted on the chassis. The gear assembly is coupled to the output shaft of the engine and the friction roller. The gear assembly creates a gear reduction such that a plurality of revolutions of the output shaft of the engine are required for every revolution of the friction roller. Handles are secured to the chassis wjereby the chassis is manipulated to position the friction roller in a working position.

6 Claims, 3 Drawing Sheets

LIQUID FUEL FRICTION APPLYING ENGINE STARTER

The present invention relates to a friction applying engine starter.

BACKGROUND OF THE INVENTION

In order to reduce costs, most engines used in the petroleum and natural gas industry on well sites do not have automatic starters. These engines must have a manual force applied to their flywheel in order to get them started. For years the manual force was applied by means of a crank. In more recent years the manual force has been applied by means of a friction applying engine starter. Friction applying engine starters have rotating wheels that are brought in contact with the flywheel. Friction is exerted by the rotating wheel of the engine starter rubbing against the flywheel of the engine imparts a rotational force to the flywheel causing the engine to start.

Friction applying engine starters that are currently in use are not very efficient. They have electric motors. The power to the electric motors is supplied from the battery of the service vehicle used by the maintenance crew through booster cables.

SUMMARY OF THE INVENTION

What is required is a more efficient configuration of friction applying engine starter.

According to the present invention there is provided a friction applying engine starter which includes a chassis having a first end, a second end, a top edge and a bottom edge. A gasoline fuelled two cycle engine mounted on the chassis. The engine has an output shaft. A fuel tank is mounted on the chassis and is coupled with the engine to supply fuel. A friction roller is rotatably mounted at a first end of the chassis. A gear assembly is provided including a plurality of gears that are rotatably mounted on the chassis. The gear assembly is coupled to the output shaft of the engine and the friction roller. The gear assembly creates a gear reduction such that a plurality of revolutions of the output shaft of the engine are required for every revolution of the friction roller. Gripping means are secured to the chassis whereby the chassis is manipulated to position the friction roller in a working position.

The friction applying engine starter, as described above, can apply many times the force of previous engine starters. It is more convenient to use.

Although the friction applying engine starter, as described above, is far more powerful that previous engine starters, with that power comes potential safety concerns. Injury can result from a rapid uncontrolled movement of the friction roller along a flywheel of an engine being started. Even more beneficial results may, therefore, be obtained when a rotational stop is spaced from the first end along at least one of the top edge and the bottom edge adjacent the friction roller. Safety is also tied to how securely the chassis can be held during operation. It is preferred that the gripping means include a first handle extending from the chassis past the second end and a second handle extending from the chassis past the top edge. It is preferable that the rotations per minute of the engine be controlled while the chassis is being firmly held. It is, therefore, preferred that wherein a throttle be positioned on the first handle.

It has been found that preferred configuration for the friction applying engine starter is that resembling a chain saw. The construction and operation of a chain saw involves similar problems regarding balancing components on the chassis while having a forwardly projecting working member. Even more beneficial results may, therefore, be obtained when the chassis includes at least one forwardly projecting fin at the first end to which the friction roller is mounted.

Although alternate gear assemblies are possible, beneficial results have been obtained when the gear assembly includes a small idler gear and a large idler gear spaced on either side of the output shaft of the engine. The small idler gear, the large idler gear and the output shaft of the engine are coupled by a drive belt such that rotation of the output shaft results in rotation of the small idler gear and the large idler gear. A drive gear is non-rotatably secured to the large idler gear and a driven gear is non-rotatably secured to the friction roller. The driven gear is larger than the drive gear. The drive gear and the driven gear are coupled by a drive chain such that a plurality of revolutions of the drive gear are required to produce each revolution of the driven gear.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
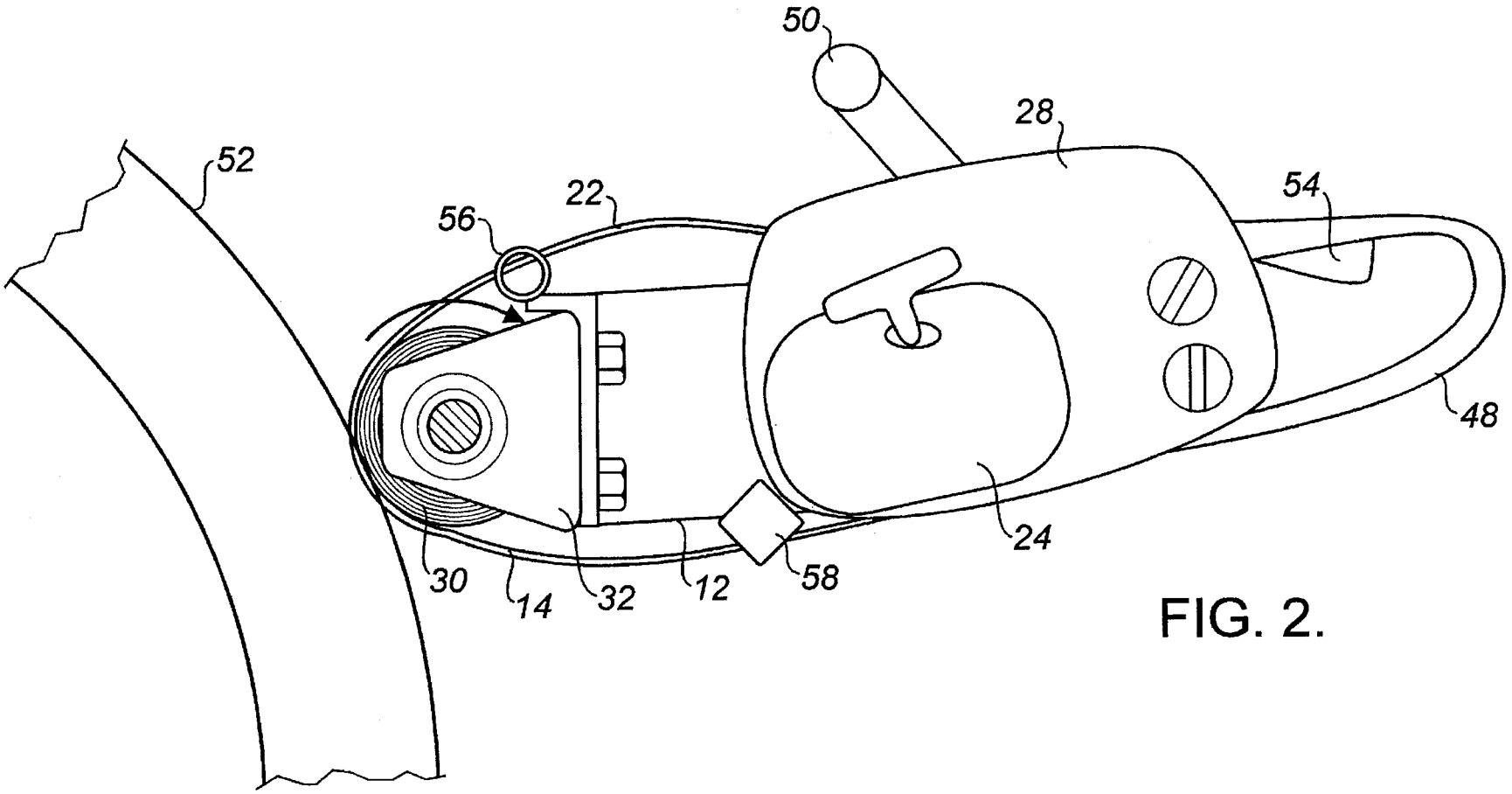
FIG. 2 is a detailed second side elevation view of the friction applying engine starter illustrated in FIG. 1.
Figure 3:
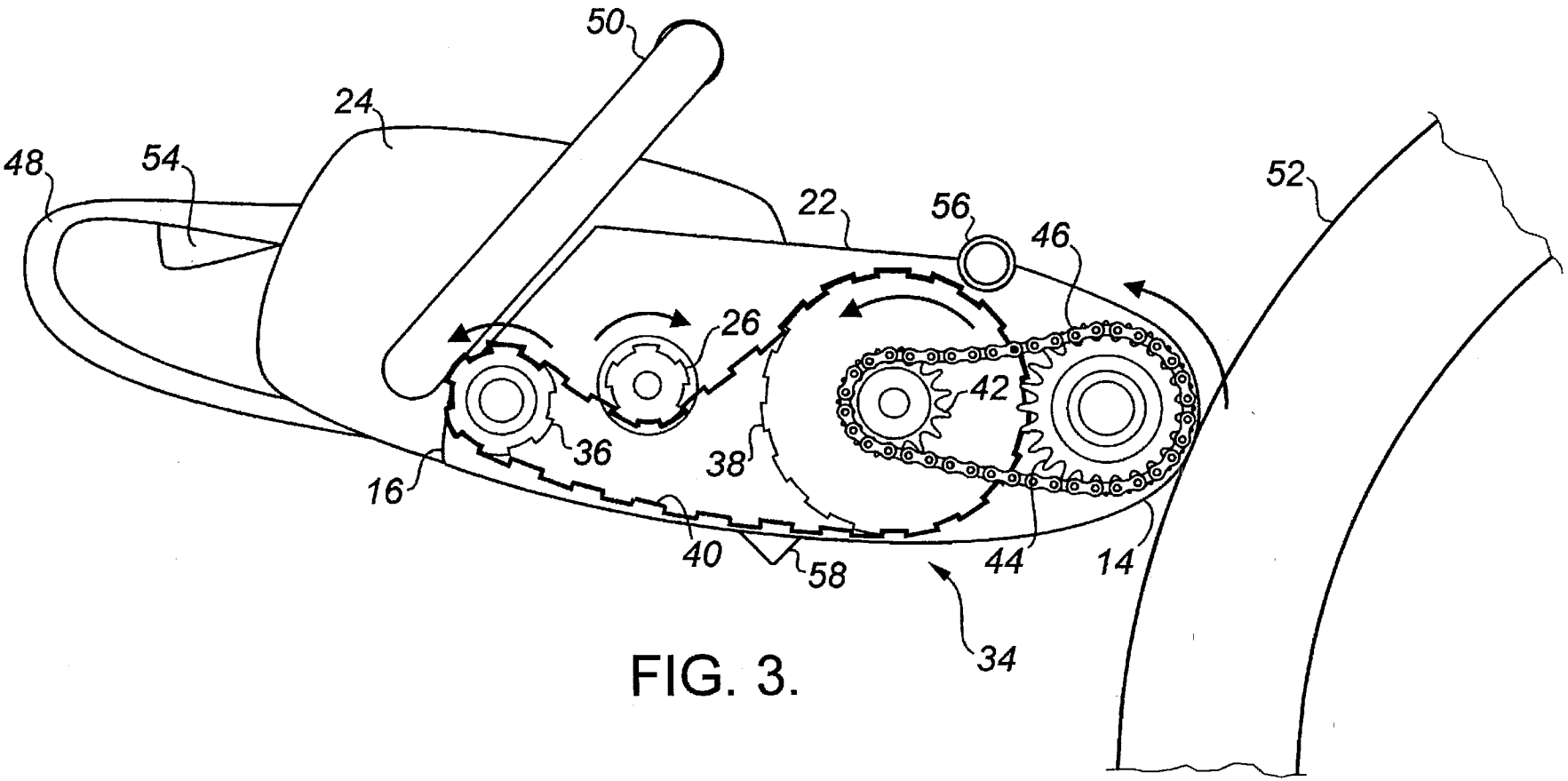
FIG. 3 is a detailed first side elevation view in section of the friction applying engine starter illustrated in FIG. 1.

The preferred embodiment, a friction applying engine starter generally identified by reference numeral 10, will now be described with reference to FIGS. 1 through 3.

Figure 1:
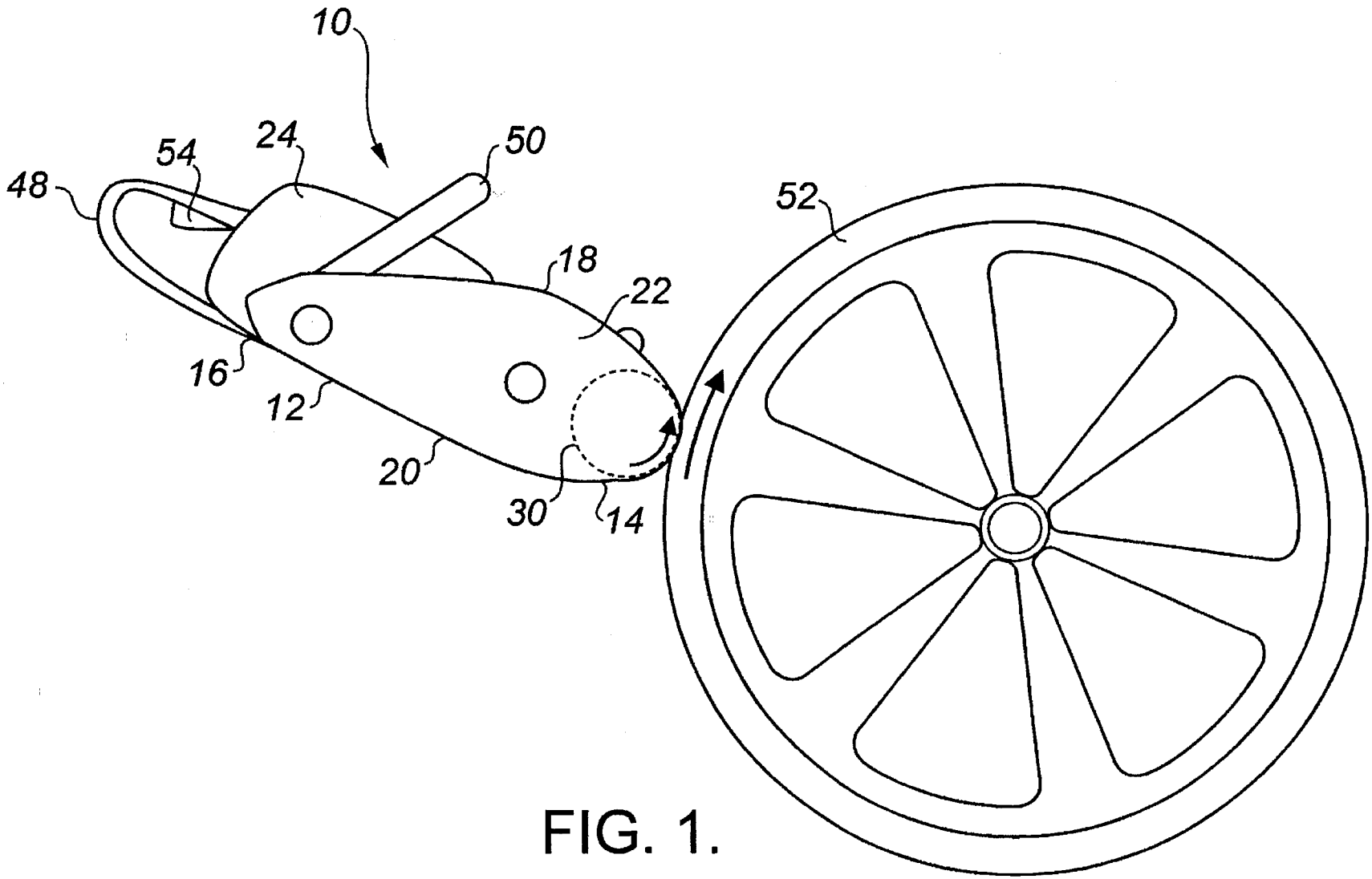
FIG. 1 is a first side elevation view of a friction applying engine starter constructed in accordance with the teachings of the present invention.

Referring to FIG. 1, friction applying engine starter 10 includes a chassis 12 having a first end 14, a second end 16, a top edge 18, and a bottom edge 20. Chassis 12 has a forwardly projecting fin 22 at first end 14, which causes friction applying engine starter 10 to resemble a chain saw chassis. A gasoline fuelled two cycle engine 24 is mounted on chassis 12. Referring to FIG. 3, engine 24 has an output shaft 26. Referring to FIG. 2, a fuel tank 28 is mounted on chassis 12 and coupled to supply fuelled to engine 24. A friction roller 30 is rotatably mounted by means of a bracket 32 which is secured to fin 22 at first end 14 of chassis 12. Referring to FIG. 3, a gear assembly, generally identified by reference numeral 34, is secured to fin 22 of chassis 12. Gear assembly 34 includes a plurality of rotatably mounted gears, as will hereinafter be further described. Gear assembly 34 is coupled to output shaft 26 of engine 24 and friction roller 30. Gear assembly 34 creates a seven to one gear reduction such that seven revolutions of output shaft 26 of engine 24 are required for every revolution of friction roller 30. Gear assembly 34 includes a small idler gear 36 and a large idler gear 38 spaced on either side of output shaft 26. Small idler gear 36, large idler gear 38 and output shaft 26 of engine 24 are coupled by a drive belt 40. Rotation of output shaft 26 results in rotation of small idler gear 36 and large idler gear 38. A drive gear 42 is non-rotatably secured to large idler gear 38. A driven gear 44 is non-rotatably secured to friction roller 30. Driven gear 44 is larger than drive gear 42. Drive gear 42 and driven gear 44 are coupled by a drive chain 46.

A plurality of revolutions of drive gear 42 are required to produce each revolution of driven gear 44. Gripping means in the form of a first handle 48 and a second handle 50 are secured to chassis 12 whereby chassis 12 is manipulated to position friction roller 30 in a working position against flywheel 52, as illustrated. First handle 48 extends from chassis 12 past second end 16. Second handle 50 extends from chassis 12 past top edge 18. A throttle 54 is positioned on first handle 48. Rotational stops 56 and 58 are spaced from first end 14 along top edge 18 and bottom edge 20, respectively adjacent friction roller 30.

The use and operation of friction applying engine starter 10 will now be described with reference to FIGS. 1 through 3. When engine 24 is in operation, output shaft 26 rotates. Rotation of output shaft 26 results in rotation of small idler gear 36 and large idler gear 38 that are coupled with output shaft 26 by means of drive belt 40. Drive gear 42 on large idler gear 38 acts upon drive gear 44 on friction roller 30 via drive chain 46 to rotate friction roller 30. Gear assembly 34 as a whole effects a gear reduction so that a seven revolutions of output shaft 26 are required to produce each revolution of friction roller 30. With chassis 12 held securely by means of first handle 48 and second handle 50, friction roller 30 is brought into rubbing contact with flywheel 52. The speed of output shaft 26 and, therefore, the speed of friction roller 30 is controlled by throttle 54. If friction roller 30 unexpectedly slides in relation to throttle 54 the resulting impact against flywheel 52 is absorbed by either rotational stop 56 or 58.

It will be apparent to one skilled in the art that modifications may be made to the illustrated embodiment without departing from the spirit and scope of the invention as defined by the claims.

The embodiments of the invention in which an exclusive property or privilege is claimed are as follows:

1. A friction applying engine starter, comprising:

a chassis having a first end, a second end, a top edge and a bottom edge;

a liquid hydrocarbon fuelled two cycle engine mounted on the chassis, the engine having an output shaft;

a fuel tank mounted on the chassis and coupled with the engine to supply fuel;

a friction roller rotatably mounted at the first end of the chassis;

a gear assembly rotatably mounted on the chassis, the gear assembly being coupled to the output shaft of the engine and the friction roller, the gear assembly rotating the friction roller in a counterclockwise direction, the gear assembly creating a gear reduction such that a plurality of revolutions of the output shaft of the engine are required for every revolution of the friction roller, the gear assembly including a small idler gear and a large idler gear spaced on either side of the output shaft of the engine with the small idler gear, the large idler gear and the output shaft of the engine being coupled by a drive belt such that rotation of the output shaft results in rotation of the small idler gear and the large idler gear, a drive gear being non-rotatably secured to the large idler gear, a driven gear being non-rotatably secured to the friction roller, the driven gear being larger than the drive gear, the drive gear and the driven gear being coupled by a drive chain such that a plurality of revolutions of the drive gear are required to produce each revolution of the driven gear; and gripping means secured to the chassis whereby the chassis is manipulated to position the friction roller in a working position.

2. The friction applying engine starter as defined in claim 1, wherein the chassis includes at least one forwardly projecting fin at the first end to which the friction roller is mounted.

3. The friction applying engine started as defined in claim 2, wherein a rotational stop is secured to the at least one projecting fin spaced from the first end along at least one of the top edge and the bottom edge adjacent the friction roller.

4. The friction applying engine starter as defined in claim 1, wherein the gripping means includes a first handle extending from the chassis past the second end and a second handle extending from the chassis past the top edge.

5. The friction applying engine starter as defined in claim 4, wherein a throttle is positioned on the first handle.

6. A friction applying engine starter, comprising:

a chassis having a first end, a second end, a top edge, a bottom edge and at least one forwardly projecting fin at the first end;

a liquid hydrocarbon fuelled two cycle engine mounted on the chassis, the engine having an output shaft;

a fuel tank mounted on the chassis and coupled with the engine to supply fuel;

a friction roller rotatably mounted to the at least one fin at a first end of the chassis;

a gear assembly rotatably mounted on the fin of the chassis, the gear assembly being coupled to the output shaft of the engine and the friction roller, the gear assembly rotating the friction roller in a counterclockwise direction, the gear assembly creating a gear reduction such that a plurality of revolutions of the output shaft of the engine are required for every revolution of the friction roller, the gear assembly includes a small idler gear and a large idler gear spaced on either side of the output shaft of the engine with the small idler gear, the large idler gear and the output shaft of the engine being coupled by a toothed drive belt such that rotation of the output shaft results in rotation of the small idler gear and the large idler gear, a driven gear being non-rotatably secured to the large idler gear, a driven gear being non-rotatably secured to the friction roller, the driven gear being larger than the drive gear, the drive gear and the driven gear being coupled by a drive chain such that a plurality of revolutions of the drive gear are required to produce each revolution of the driven gear;

gripping means secured to the chassis whereby the chassis is manipulated to position the friction roller in a working position, the gripping means includes a first handle extending from the chassis past the second end and a second handle extending from the chassis past the top edge;

a throttle is positioned on the first handle; and rotational stops secured to the at least one projecting fin spaced from the first end along the top edge and the bottom edge adjacent the friction roller.

* * * * *